US006381925B2

(12) United States Patent
Rejcek et al.

(10) Patent No.: US 6,381,925 B2
(45) Date of Patent: May 7, 2002

(54) METHOD FOR FORMING A COMPRESSED GROUPING OF OBJECTS

(75) Inventors: Dennis Rejcek; Terry Brinkerhuff; Ron Rieger; Dennis Lenart; Mike McGee; Johnny Black, all of Waco, TX (US)

(73) Assignee: Mars, Incorporated, McLean, VA (US)

( * ) Notice: Subject to any disclaimer, the term of this patent is extended or adjusted under 35 U.S.C. 154(b) by 0 days.

(21) Appl. No.: 09/875,966

(22) Filed: Jun. 8, 2001

Related U.S. Application Data

(62) Division of application No. 09/361,415, filed on Jul. 27, 1999.

(51) Int. Cl.[7] ..... B65B 13/20; B65B 35/30

(52) U.S. Cl. ..... 53/436; 53/439; 53/443; 53/448

(58) Field of Search ..... 53/443, 436, 448, 53/147, 151, 153, 531, 532, 533, 535, 542, 439; 198/375, 377.01, 377.03, 377.07, 418.1, 418.2, 418.4, 418.5, 418.7, 426, 427, 433, 469.1

(56) References Cited

U.S. PATENT DOCUMENTS

| | | | | |
|---|---|---|---|---|
| 3,032,211 A | | 5/1962 | Wordsworth | |
| 3,268,054 A | | 8/1966 | Murphy, Jr. et al. | |
| 3,362,128 A | * | 1/1968 | James | 53/436 |
| 3,645,069 A | | 2/1972 | Waite | |
| 3,766,706 A | | 10/1973 | Graham | |
| 4,019,624 A | | 4/1977 | Torres | |
| 4,221,287 A | | 9/1980 | Seragnoli | |
| 4,223,779 A | | 9/1980 | Hopkins | |
| 4,455,902 A | | 6/1984 | Schmitz | |
| 4,682,684 A | | 7/1987 | Löthman | |
| 4,688,373 A | | 8/1987 | Parlour | |
| 5,081,823 A | | 1/1992 | Van der Ent | |
| 5,160,558 A | | 11/1992 | Gardener | |
| 5,890,350 A | | 4/1999 | Tisma | |
| 5,979,145 A | * | 11/1999 | Louis et al. | 53/436 |

FOREIGN PATENT DOCUMENTS

| | | |
|---|---|---|
| EP | 611696 A2 | 8/1994 |

* cited by examiner

*Primary Examiner*—Stephen F. Gerrity
*Assistant Examiner*—Louis Huynh
(74) *Attorney, Agent, or Firm*—Fitzpatrick, Cella, Harper & Scinto

(57) ABSTRACT

The present invention is directed to an apparatus for compressing a plurality of objects into a compressed grouping and transferring said compressed grouping to a transfer conveyor. The apparatus includes a rotatable cylinder having a plurality of receiving areas positioned around the circumference of the cylinder for receiving a plurality of objects in expanded arrangement from an infeed conveyor at a receiving position. The apparatus also includes first and second compression members, one positioned on each end of said cylinder adjacent the receiving areas and covering a circumferential-portion of a side of said cylinder. The compression members include inclined portion which force the end objects toward the longitudinal center of the cylinder. In addition, a transfer conveyor running longitudinally through the cylinder for capturing a compressed grouping at the transfer position.

20 Claims, 7 Drawing Sheets

METHOD FOR FORMING A COMPRESSED GROUPING OF OBJECTS

This application is a divisional of U.S. patent application Ser. No. 09/361,415, filed Jul. 27, 1999 and herein incorporated by reference.

BACKGROUND OF THE INVENTION

1. Field of the Invention

The present invention relates to mixing equipment for mixing objects for packaging, and more particularly to an apparatus for intermittently-intermixing multiple objects, compressing the objects into a compressed grouping, accelerating the compressed grouping up to the speed of a constant velocity transfer conveyor, and transferring the compressed grouping thereto.

2. Related Background Art

Many popular candies, snack and other foodstuffs are often packaged together in multiple flavor or multiple color groupings. These groupings are often packaged in single, in-line rows or what is commonly referred to in the art as "stickpacks". However, the quality of the groupings is frequently poor when using existing packaging techniques, since individual items often become disoriented and/or break during the packaging process.

It has also been a problem that the existing techniques for packaging stickpacks also require excessive amounts of direct labor, space and complicated equipment, resulting in an economically unsatisfactory overall candy making and packaging operation.

SUMMARY OF THE INVENTION

Accordingly, the present invention presents new apparatuses and methods for virtually eliminating objects becoming disoriented and broken when packaged in in-line groupings, with relatively simple and low-cost designs that require minimal space.

The present invention provides an automatic mixing, compressing, and transfer mechanism which automatically collects uniformly sized individual objects, such as pieces of candy, from a multi-lane infeed conveyor system, assembles the multiple items in a single row, compresses the objects into a compressed grouping, accelerates the compressed grouping from a stationary position and transfers the compressed grouping to a steady, continuous motion, constant velocity transfer conveyor.

The invention includes a hollow indexing cylinder, or rotor-ring, which provides reduced inertia for increased speed capability. The high speed of the compressing device according to the present invention enables, for example, approximately 400 groupings per minute to be fed to a constant velocity transfer conveyor, while maintaining high quality groupings, i.e., the process is substantially free of individual objects that fall, break or become disoriented.

The preferred transfer conveyor which transports the compressed groupings includes a constant velocity belt or chain running through the rotor ring, and includes a cam operated, pivotal front-lug that captures, with the aid of a rear-lug, a compressed grouping of objects each time the rotor-ring pauses at a transfer position.

As explained in the detailed description which follows, operation of the automatic transfer mechanism according to the present invention, and more specifically, the movement of objects from a receiving position where the objects are provided in parallel, expanded arrangement on an infeed conveyor, produces an assembled and compressed in-line, serial type grouping. Each compressed grouping is accelerated to a velocity that matches a constant velocity of the transfer conveyor, which receives the compressed grouping for transfer to a packaging device. The compression and transfer operation is synchronized to provide smooth, efficient and high speed operation.

Thus, it is an object of the present invention to provide a mixing and compressing apparatus which is simple in design.

It is another object of the present invention to provide a mixing and compressing apparatus which is low cost.

It is another object of the present invention to provide a mixing and compressing apparatus for mixing and compressing a plurality of objects to produce compressed groupings of any size.

It is yet another object of the present invention to provide a mixing and compressing apparatus that intermittently-intermixes a plurality of different color/flavor candies. It is yet another object of the present invention to provide a mixing and compressing apparatus that intermittently-intermixes a plurality of different objects of the same dimensions.

It is yet another object of the present invention to provide a mixing and compressing apparatus for mixing and compressing a plurality of objects into a compressed grouping, and then accelerating the grouping from a stationary position to a constant velocity, and transferring the compressed grouping to a transfer conveyor.

To accomplish the foregoing objects and advantages, one aspect of the present invention is directed to a compression apparatus which includes a rotatable body having a receiving area positioned on the perimeter of the body for receiving a plurality of objects in expanded arrangement from an infeed conveyor at a receiving position. The apparatus also includes a compression conveyor positioned longitudinally adjacent the body at a transfer position. The compression conveyor includes a compression element for pushing an end object into the other objects to form the compressed grouping at the transfer position and transport the compressed grouping away from the transfer position.

Another aspect of this invention is directed to a compression apparatus having a rotatable body including a receiving area positioned on the perimeter of the rotatable body for receiving a plurality of objects in expanded arrangement from an infeed conveyor at a receiving position and also includes a compression member positioned on an end of the rotatable body, surrounding a portion of a side of the rotatable body. The compression member includes an inclining portion commencing from a start position on the side of the compression member facing the longitudinal center of the rotatable body and inclining toward the longitudinal center of the rotatable body to a transfer position. The start position is aligned adjacent said receiving position, and the objects received in said receiving area are compressed by relative motion between the rotatable body and the compression member.

Yet another aspect of the present invention is directed to a compression apparatus as described above and also includes a transfer conveyor located longitudinally through the rotatable body and having a capture member for capturing the compressed grouping at the transfer position and transporting the compressed grouping to a packaging device.

Yet another aspect of the present invention is directed to a method for compressing a plurality of objects into a compressed grouping and transferring the compressed grouping to a packaging device. The compression apparatus includes a rotatable body having a receiving area positioned on the perimeter of the rotatable body for receiving a plurality of objects in expanded arrangement from an infeed conveyor at a receiving position, and a compression conveyor located longitudinally adjacent the rotatable body at a transfer position and includes a compression member for forcing an end object in the receiving area into the other objects to compress the objects into a compressed grouping and transport the compressed grouping away from the transfer position. The method includes the steps of receiving a plurality of objects from the infeed conveyor into the receiving area at the receiving position, rotating the rotatable body to the transfer position, pausing the rotation of the rotatable body when the receiving area having the plurality of objects reaches the transfer position, positioning the compression member immediately behind an end object from the receiving area when the objects arrive at the transfer position, compressing the objects together to form a compressed grouping by forcing the compression member into the end object and the remaining objects, and transporting the compressed grouping out of the receiving area during the pausing of the rotation of the cylinder.

Still another aspect of the present invention is directed to a method for compressing a plurality of objects into a compressed grouping with a compression apparatus. The compression apparatus includes a rotatable body having a receiving area positioned on the perimeter of the rotatable body for receiving a plurality of objects in expanded arrangement from an infeed conveyor at a receiving position and a compression member positioned on an end of the rotatable body and surrounding a portion of a side of the rotatable body. The compression member includes an inclining portion commencing from a start position located on the side of the compression member facing the longitudinal center of the rotatable body and inclining toward the longitudinal center of the rotatable body to a transfer position, with the start position aligned adjacent said receiving position. The method includes the steps of receiving a plurality of objects from the infeed conveyor into the receiving area at the receiving position, compressing the plurality of objects by rotating the rotatable body and the compression member relative to one another so that the object received from the infeed conveyor and positioned adjacent the start position is forced toward the longitudinal center of the rotatable body by riding along the inclined portion.

Still another aspect of the present invention is directed to a similar method for compressing a plurality of objects into a compressed grouping in a compression apparatus and transferring the compressed grouping to a packaging device. The compression apparatus includes the same features as recited above, and also includes a transfer conveyor located longitudinally adjacent the rotatable body and including a capturing member for capturing the compressed grouping at the transfer position. The method is the same as that described in the previous aspect, but also includes the additional steps of pausing the rotation of the rotatable body when the receiving area having the compressed grouping reaches the transfer position, positioning the capturing member around the compressed grouping when the compressed grouping arrives at the transfer position, conveying the compressed grouping out of the receiving area at the transfer position and along the transfer conveyor.

Still yet another aspect of the present invention is directed to an apparatus for compressing a plurality of objects into a compressed grouping and transferring the compressed grouping to a packaging device. The apparatus includes a rotatable body having a plurality of receiving areas positioned around the circumference of the rotatable body for receiving a plurality of objects in expanded arrangement from an infeed conveyor at a receiving position, where the infeed conveyor includes a plurality of individual lanes. The apparatus also includes a first compression member positioned on one end of the rotatable body adjacent the receiving areas and surrounding a portion of a side of the rotatable body and a second compression member positioned on the other end of the rotatable body and surrounding a portion of the other side of the rotatable body. The compression members include an inclining portion commencing from a start position on the side of each compression member facing the longitudinal center of the rotatable body and inclining toward the longitudinal center of the rotatable body to a transfer position, with the start position located adjacent said receiving position. The objects received in the receiving area are compressed into a group by relative motion between the rotatable body and the compression members. The apparatus also includes a transfer conveyor located longitudinally through the rotatable body having a first capture element and a second capture element for capturing the compressed grouping at the transfer position and transporting the compressed grouping out of the receiving area and away from the transfer position.

Many different objects may be compressed using the apparatuses and methods of this invention. A particularly preferred group of objects are confectionaries, and most preferably candy bars and square or rectangular shaped candy pieces such as STARBURST® brand candies available from M&M/Mars, Inc., Hackettstown, N.J. Other objects which could be compressed in the apparatus according to the present invention include non-food items such as nuts, soap bars, washers, sponges, and the like.

These and other aspects and objects, and many of the attendant advantages of this invention will be readily appreciated and understood by reference to the following detailed description when considered in connection with the accompany drawings.

DETAILED DESCRIPTION OF THE INVENTION

Figure 1:
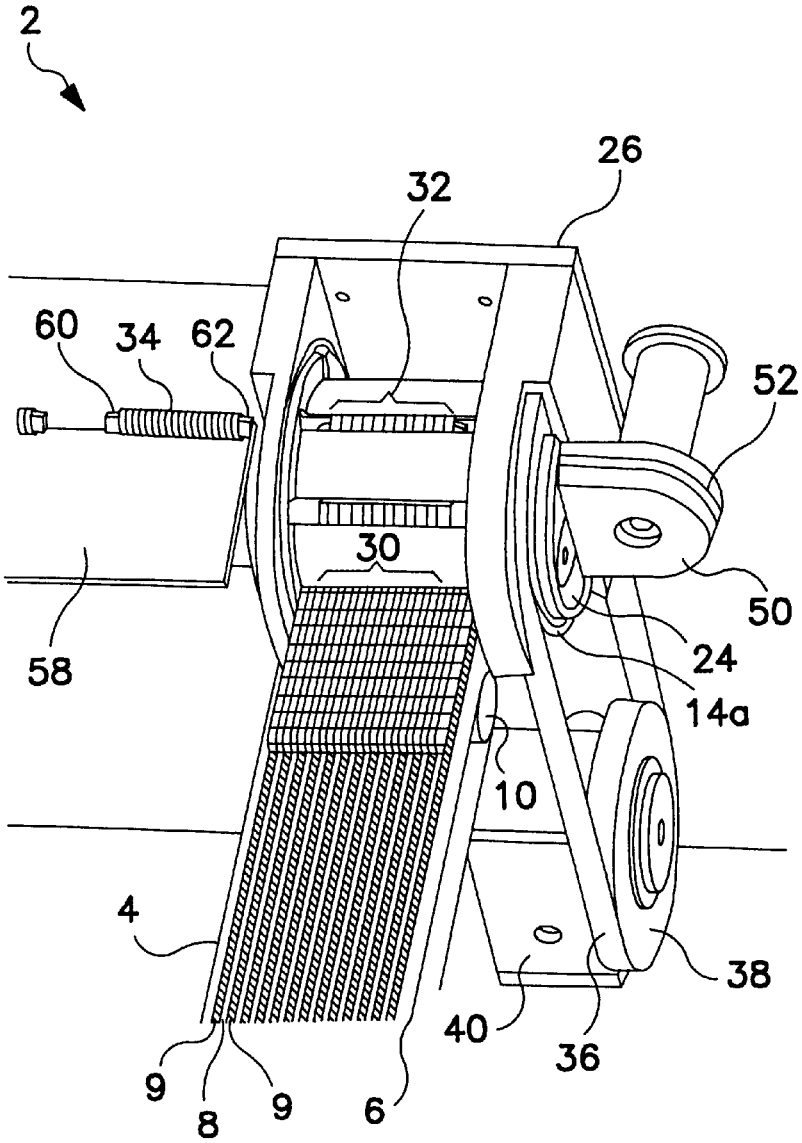
FIG. 1 is a partial, perspective view of the mixing, compressing and transfer device according to a first embodiment of the present invention.
Figure 2:
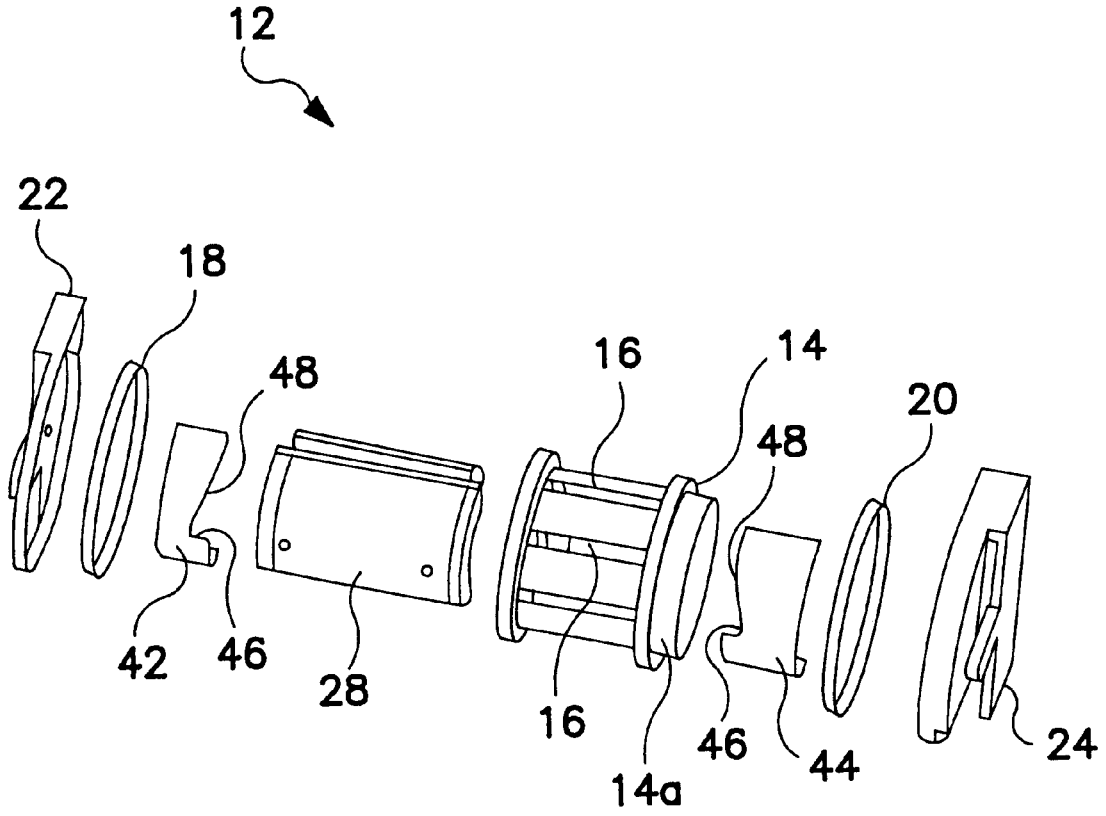
FIG. 2 is an exploded, perspective view of the mixing and compressing device according to the present invention.

Referring to FIGS. 1–7, an exemplary compression apparatus 2 of this invention is shown with a rotor-ring assembly 12. The assembly includes rotor-ring or cylinder 14, hollow in design, which includes a plurality of receiving areas 16, or openings, for receiving a row of objects, preferably candies, in expanded parallel arrangement from an infeed conveyor 4. Side bearings 18 and 20, are positioned between the cylinder 14 and an idler side plate 22 and a drive side plate 24, respectively, and allow the cylinder 14 to rotate smoothly within the apparatus. For structural integrity, the apparatus is affixed to support structure 26 and other support members (not shown).

The infeed conveyor 4 supplies a steady stream of objects 33 for compressing by the rotor-ring assembly and includes a belt 6 for accommodating a plurality of separated lanes 8, each lane 8 including a pair of dividing walls 9, positioned on either side of the lane, for providing a barrier for escaping objects. At the end of the conveyor is a return pulley 10 for directing the infeed conveyor belt back to the point of origin for pickup of more objects to be compressed (not shown).

As shown in the figures, the lanes preferably are equal in width, and thus, all lanes accommodate the same or similar size objects. The present invention, however, is not limited to mixing and compressing similar, same size objects.

The receiving areas 16 of the cylinder 14 are approximately equally spaced apart along the entire 360 degree circumference of the cylinder. The receiving areas 16 preferably are simple rectangular-like openings, generally positioned along the entire length of the cylinder, which open into the center of the cylinder, and equally spaced apart from one another around the circumference of the cylinder. They include a top and bottom surface spaced apart from one another at a distance equal approximately to the height of the received objects. It will be appreciated that other shaped receiving areas may be used to accommodate different sized/shaped objects.

Figure 3A:
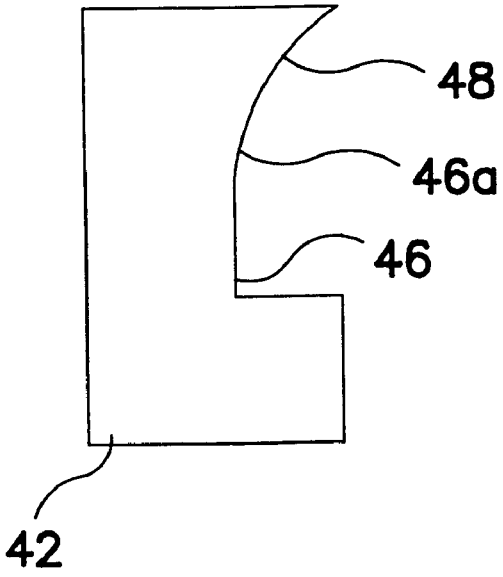
FIG. 3A is a front view of a compression member for use with the mixing and compressing apparatus according the present invention.
Figure 3B:
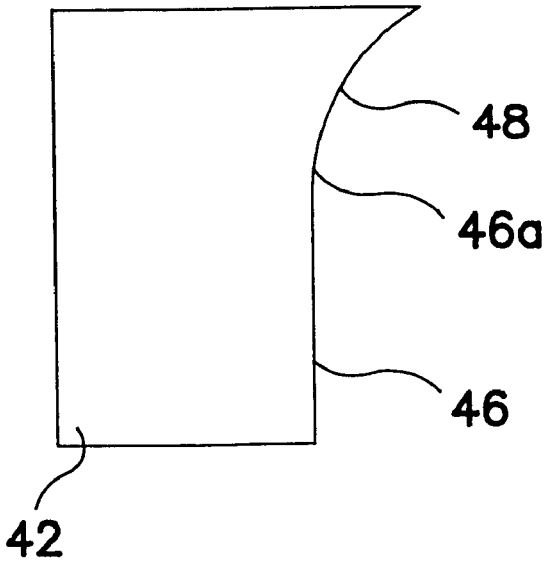
FIG. 3B is a front view of an alternative design for a compression member for use with the mixing and compressing apparatus according the present invention.
Figure 3C:
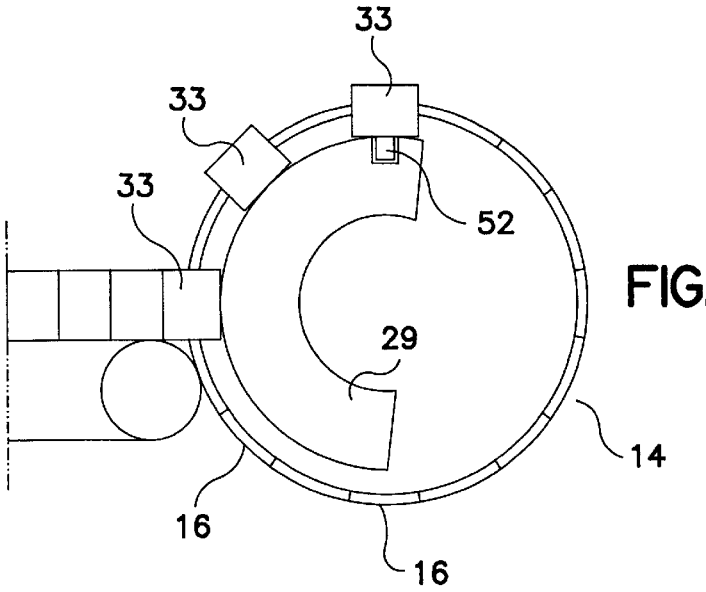
FIG. 3C is a side, schematic view of the compression apparatus according to the present invention illustrating the positioning of a barrier member relative to the rotating cylinder and receiving areas.

To ensure that the objects 33 received in the receiving areas 16 do not drop into the interior of the cylinder 14, a curved barrier member or backup plate 29, as shown in FIG. 3C, having a curved shape which conforms generally to the shape of the interior surface of the cylinder 14, is positioned within the interior of the cylinder to provide a barrier for the incoming objects. Preferably, the spacing between the backup plate 29 and the wall of the cylinder 14 equals approximately 30–70% of the overall length of the objects, and more preferably between 40–60%, and most preferably between 45–55%.

Figure 3D:
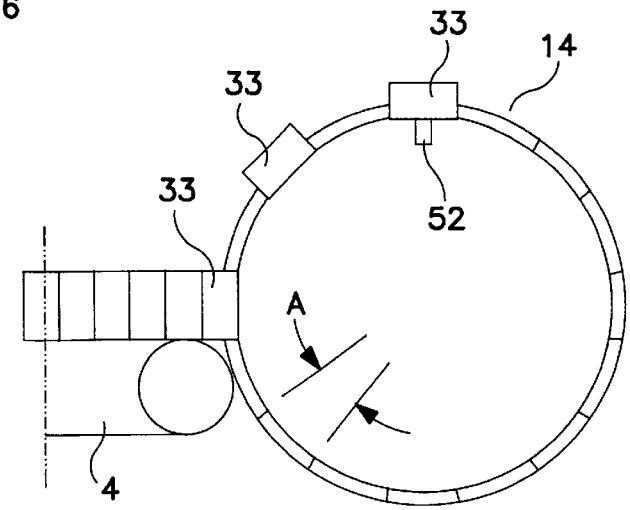
FIG. 3D is a side, schematic view of the compression apparatus according to the present invention illustrating the angle formed between the upper wall and the lower wall of each receiving area.
Figure 3E:
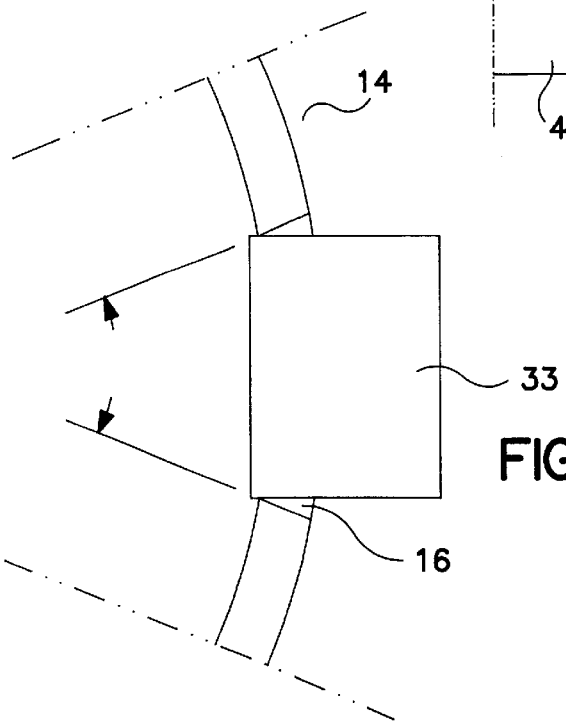
FIG. 3E illustrates an enlargement of one of the receiving areas for the rotatable cylinder according to the present invention which illustrates angled top and bottom surfaces for retaining an object in the receiving area.

Alternatively, instead of, or in addition to, using the barrier member, the top and bottom surfaces of the receiving areas may be positioned to form an angle to retain objects 33 received therein. As shown in FIGS. 3D and 3E, an angle A is such that the top and bottom surfaces of the receiving area frictionally receive the objects. In other words, the received objects become wedged between the two surfaces. Thus, the received objects are barred from falling into the interior of the cylinder because the objects wedge themselves between the two surfaces.

Rotation is provided to the cylinder 14, by turning each receiving area 16 from a receiving position 30, located adjacent the infeed conveyor 4, to a transfer position 32, and then back thereto. At each position, the rotation of the cylinder 14 is paused so that a compressed grouping 34 of objects can be transferred and so that an expanded grouping of objects from the infeed conveyor 4 can be received. This intermittent rotation is accomplished by way of any number of indexing means familiar to those skilled in the art. For example, the cylinder 14 may be rotated by including a pulley 14*a* driven by a belt 36 attached to a clutch-pulley 38 positioned on an indexing motor 40. The clutch of the clutch-pulley 38 is activated, through either electrical or mechanical means, to rotate the cylinder 14. Of course, a clutchless pulley may be used if the indexing motor already provides for intermittent motion.

Positioned on either side of the cylinder 14 are compression bars 42 and 44 for compressing the objects. The compression bars are arranged in identical positions on either side of the cylinder 14, and surround a portion of the circumference of the cylinder immediately adjacent the outer surface. In the preferred embodiment, the bars remain fixed, or static, relative to the rotation of the cylinder 14, although one skilled in the art would appreciate that any relative motion between the cylinder and compression bars can operate to compress the expanded objects. It is noted that although the present invention is preferably used with two compression members, one or more compression members may be used, depending upon the required grouping configurations (see FIGS. 5-7).

As illustrated, in FIGS. 3A and 3B, each compression bar includes a start position, which is located adjacent the end of the lanes 8 on the infeed conveyor 4 at the receiving position 30, on either side of the belt 6. In the figures, the start position is shown as a notch 46 (FIG. 3A). At a distance apart from the start position or notch 46, equal to approximately the height of the object received and starting at the depth of the notch is a ramp 48 which inclines from an end 46*a* of the start position or notch 46, and winds circumferentially around the cylinder toward the longitudinal center of the rotatable cylinder, ending at the transfer position 32. The notch 46 and ramp 48 of each compression bar provide a lateral barrier to each side of the grouping of objects received. Thus, as the cylinder 14 is rotated within the compression bars 42 and 44, the notches 46 (initially) and the ramps 48 force, after rotation begins, the end objects toward each other and toward the longitudinal center of the cylinder 14, thus compressing the objects into a compressed grouping.

Figure 5:
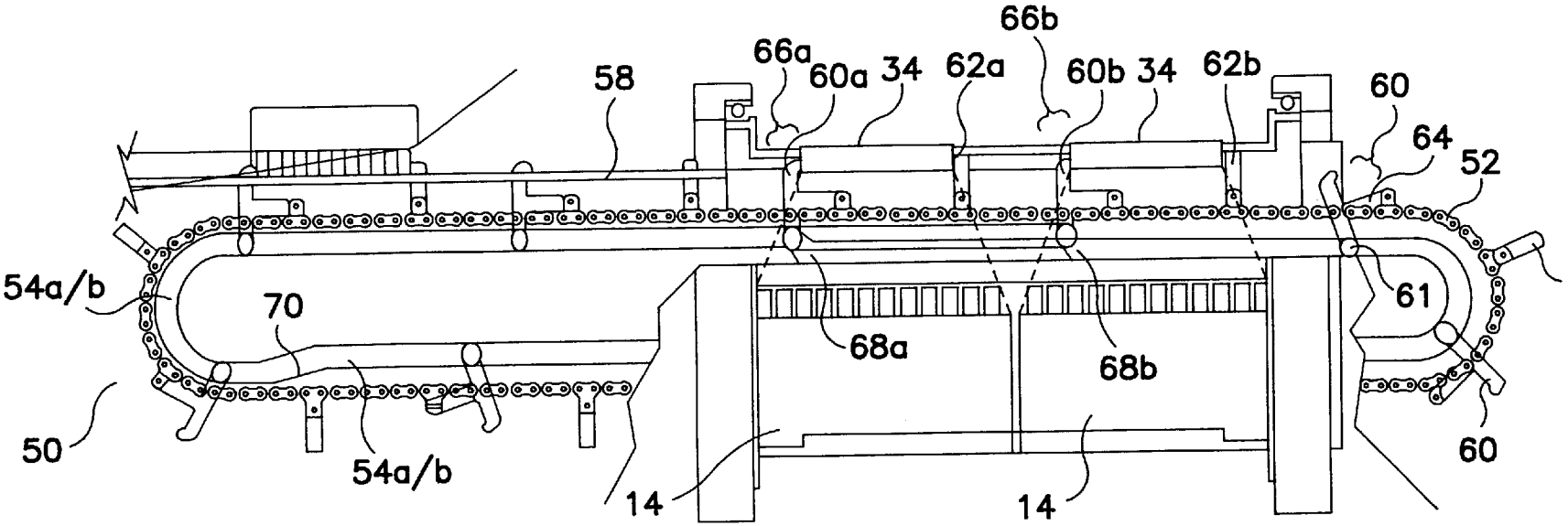
FIG. 5 is a side, partial cut-away view of the mixing, compressing and transfer device according the second embodiment for the present invention.

Once the objects have been received, mixed and compressed, they are accelerated and transferred to a transfer conveyor 50 for delivery to a packaging apparatus (not shown). As shown in FIGS. 1 and 5, positioned within the rotor-ring assembly 12 and indexing means is the transfer conveyor 50, having a belt or chain 52, a camming track 54, and support structure 58. The chain 52 is preferably operated at a constant velocity by use of a motor (not shown) and runs through the rotor-ring assembly at or adjacent the transfer position 32. Positioned at specific locations on the chain 52 are front capturing elements or lugs 60 and rear capturing elements or lugs 62 for capturing and transferring compressed groupings.

The capturing elements may include any structural element which can capture the grouping. For example, they may be lugs, as described above, or may also be hooks, pins and the like.

The front lugs are spaced apart from the rear lugs such that when capturing a compressed grouping, the distance between the front lug and the rear lug is approximately equal to the distance of the compressed grouping. More specifically, the distance between the lugs is approximately equal to the longitudinal distance between the end of the ramp on one compression bar to the identical end of the ramp on the other compression bar at the transfer position.

Figure 7:
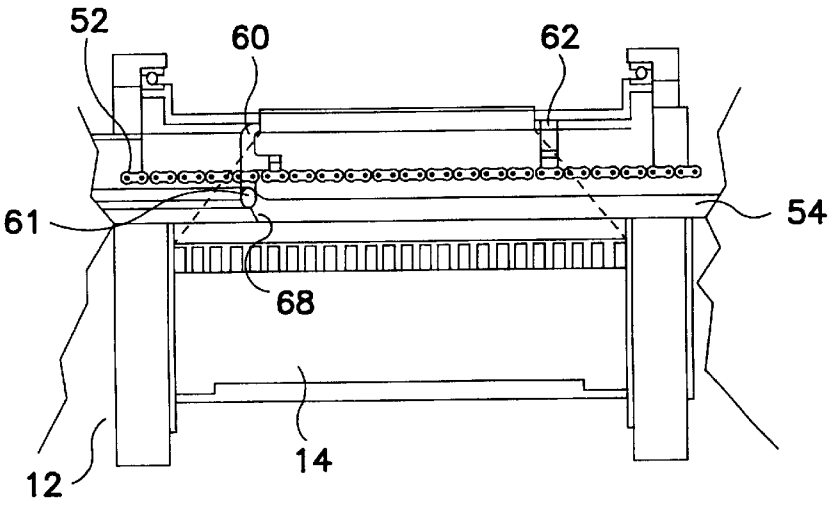
FIG. 7 is a partial, side view of the mixing, compressing and transfer device according to a fourth embodiment for the present invention, illustrating the device with a single grouping of 24 objects.

As shown in FIG. 7, each front lug 60 is pivotally mounted to the chain 52, and includes extension portion 61, a portion of which is located within the camming track. The extension portion 61 includes a lower end for interaction with a camming surface 68 positioned on or adjacent the camming track. When the lower end of a front lug encounters a camming surface, it pivots the corresponding front lug from either a receiving position to a capturing position, or from a capturing position to a receiving position. The camming surface may be a step, a groove, rib or other surface which allows the lower end of each extension portion of each front lug to ride within or on to cause movement in the upper part of the front lug. For illustration purposes, the present invention will be described using a camming step.

This interaction between the camming step and lower end of each extension portion of each front lug allows the front lug 60 and rear lug 62 to capture the entire compressed grouping at the transfer position with ease. In contrast to the front lugs 60, the rear lugs 62 preferably do not pivot, although the present invention may be designed so that the front lugs 60 remained fixed and the rear lugs 62 pivot.

One skilled in the art will appreciate that other mechanical and electrical devices for actuating and pivoting the front lugs from a receiving position to a capture position, and back thereto, when capturing single or multiple groupings, are also possible.

Figure 4:
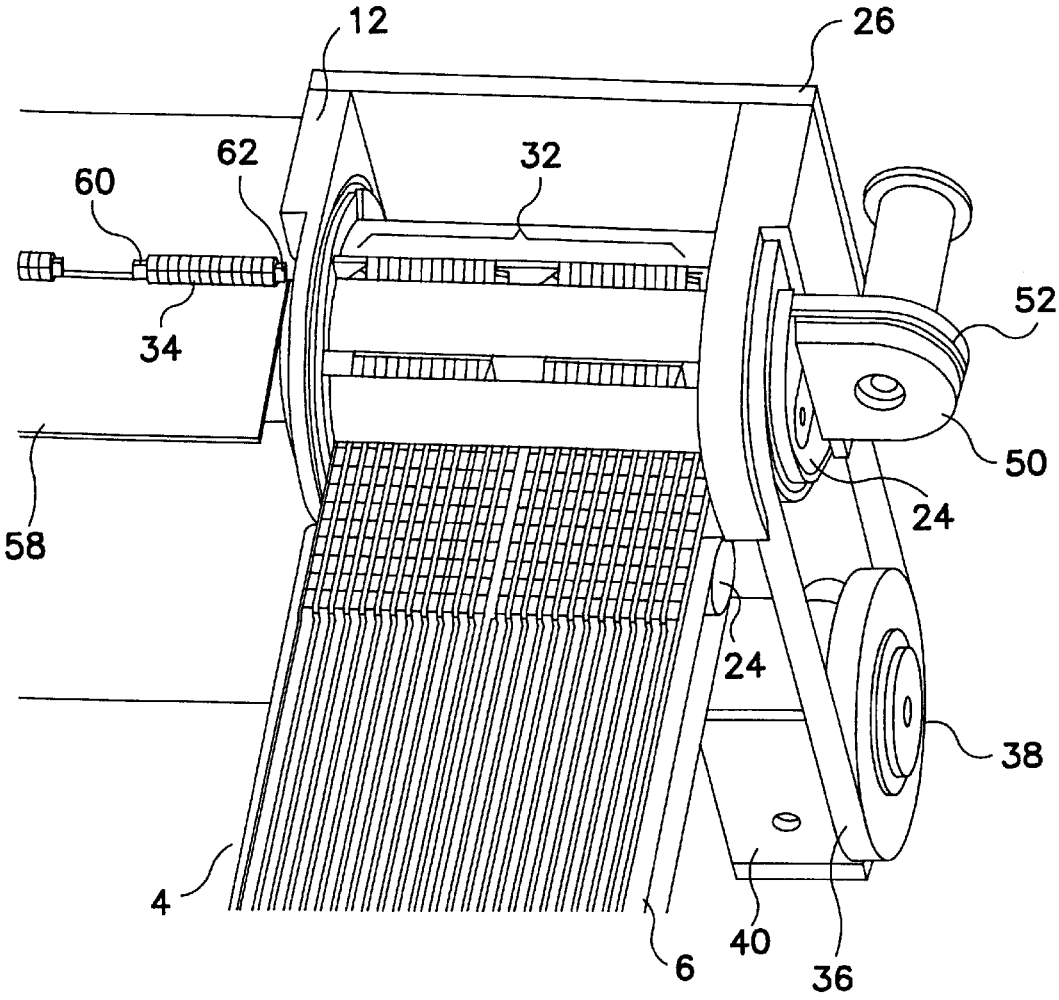
FIG. 4 is a perspective view of the mixing, compressing and transfer device according to a second embodiment for the present invention.
Figure 6:
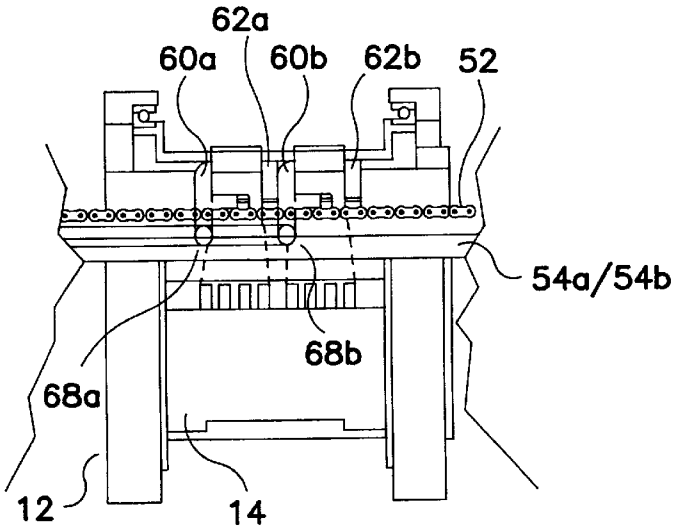
FIG. 6 is a partial, side view of the mixing, compressing and transfer device according to a third embodiment for the present invention, illustrating the device with two groupings of four objects.

It will be appreciated that camming track 54 may consist of multiple lanes to accommodate multiple pairs of capturing elements. For example, as shown in FIGS. 4, 5 and 6, two compressed groupings are captured at the same time by two pairs of front and rear capture elements. Accordingly, to capture two groupings, there is a first camming track 54*a* and a second camming track 54*b*, which lie adjacent and parallel to one another. Thus, one is superimposed on the other in the side view as illustrated in FIGS. 5 and 6. Each camming track contains camming steps to actuate the front lugs of each grouping as described above. As shown in the figures, camming step 68*a*, located on camming track 54*a*, actuates front lug 60*a* to the capturing position to capture a grouping with rear lug 62*a*, and camming step 68*b*, located on camming track 54*b*, actuates front lug 60*b* to the capturing position to capture a second grouping with rear lug 62*b*.

As shown in FIG. 5, the top portions of the front lugs 60*a* and 60*b* lie along the same line to capture two groupings positioned in each receiving area of each cylinder 14 at the common, in-line transfer position. However, the lower ends of the extension members of the front lugs 60*a* and 60*b* lie within different, parallel camming tracks positioned adjacent one another. Thus, the lower end of extension portion of front lug 60*a* lies in camming track 54*a* to be actuated by camming step 68*a* positioned within camming track 54*a*, and the extension portion of front lug 60*b* lies in camming track 54*b* to be actuated by camming step 68*b* positioned within camming track 54*b*.

The pivoting of the front lugs 60*a* and 60*b* occurs when the lower ends of the extension portions 61*a* and 61*b* encounter the camming steps 68*a*, 68*b* and 70*a*, 70*b*, positioned on the corresponding conveyor tracks 54*a*, 54*b*. The camming steps 68*a*, 68*b* force the front lugs 60*a*, 60*b* to pivot from the receiving position 64 into the capture position 66. In contrast, camming steps 70*a*, 70*b* force the front lugs 60*a*, 60*b* to pivot from the capture position back to the receiving position. Accordingly, when the compressed groupings pause at the transfer position 32, camming steps 68*a*, 68*b* force the front lugs 60*a*, 60*b* to pivot clockwise into the capturing position 66*a*, 66*b* to capture the corresponding compressed grouping at nearly the exact moment when the groupings arrive at the common transfer position 32. In addition, when the compressed groupings are finally transferred from the transfer conveyor 50 to a flow wrap machine, another conveyor or other device, the front lugs 60*a*, 60*b* are caused to pivot counterclockwise back to the receiving position 64 after the lower ends encounter camming steps 70*a* and 70*b*.

Alternatively, there may also be a single camming track with camming steps located on each side of the camming track for alternating front lugs. The lower end of each extension portion of each front lug would be designed to be actuated by a particular camming step. Thus, for example, the lower end of the extension portion of a first front lug to capture a first grouping encounters a first camming step positioned on one side of the camming track, and a lower end of the extension portion of a subsequent front lug to capture a second grouping encounters a second camming step positioned on the opposite side of the camming track.

Accordingly, the method for intermittently mixing, compressing a plurality of objects received and transferring a compressed grouping according to the invention illustrated in FIGS. 1–7 in parallel from the lanes 8 of the infeed conveyor 4 into a tight grouping for the apparatus is as follows. First, one object 5 positioned in each lane 8 of infeed conveyor 4 are separated from each lane by the angular motion of the rotor-ring cylinder 14 in the clockwise direction, indexed into one of the receiving areas 16 positioned at the receiving position 30. Continued forward progression of the objects into the cylinder is halted by the backup plate 29, or the wedge shape of the top and bottom walls of the receiving area.

The expanded grouping is then rotated to the transfer position 32, by turning the cylinder 14 within the compression bars. The objects are compressed together by the relative rotation of the cylinder 14 within the compression bars, where each object located immediately adjacent each start position 46 and ramp 48 of each compression bar is forced toward the longitudinal center of the cylinder 14, and thus toward adjacent objects.

As the filled receiving area is rotated to the transfer position 32, rear lug 62 on the chain 52 of the transfer conveyor 50 is timed to take over and transport the compressed grouping of objects in a direction approximately perpendicular to supply direction of the infeed conveyor 4. Synchronized with the arrival of the grouping to the transfer position 32, extension member 61 encounters camming step 68 on track 54, which forces front lug 60 to pivot clockwise to capture the compressed grouping from the receiving area 16. As soon as the rear lug 62 clears the cylinder 14, the cylinder 14 is rotated to position another compressed grouping at the transfer position 32, and to position an empty receiving area 16 at the receiving position 30. Thus, when a compressed grouping arrives at the transfer position, an empty receiving area concurrently arrives at the receiving position.

Figure 8:
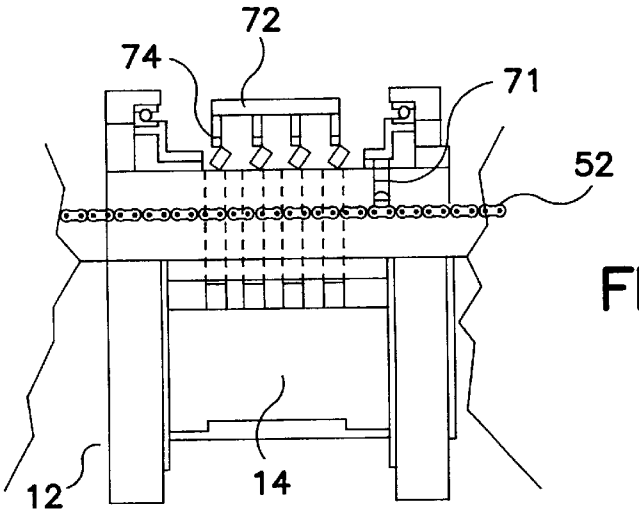
FIG. 8 is a partial, side view of a mixing and transfer device according to a fifth embodiment for the present invention.

Alternatively, another embodiment for the present invention provides a mixing, compressing and transfer apparatus which may be used without compression bars as shown in FIG. 8. FIG. 8 illustrates a four-piece pack where the items are compressed together by the motion of a compression or transfer conveyor.

For this embodiment, the objects are compressed after they reach the transfer position. Specifically, when the objects received in the receiving area reach the transfer position 32, they are compressed by action of a single compression element or lug 71 located on the transfer conveyor chain and timed to reach the transfer position at the same time as the group. As the lug 71 pushes the end object, it is forced into the next adjacent object, which in turn is forced into the next adjacent object, thus compressing the objects into a compressed grouping. This embodiment is preferably used to compress objects that are generally flat and rectangular like in shape, e.g., rectangular blocks of chewing gum, chocolates, caramel and the like.

A positioning member 72, as shown in FIG. 8, having positioning fingers 74 may be used to re-position received objects at the transfer position from a vertical arrangement to a horizontal arrangement. This re-positioning occurs generally prior to the transfer conveyor compressing the objects into a compressed grouping, so that the compressed grouping can be packaged in a flat, long pack, as opposed to a tall, short pack. In effect, the re-positioning member knocks the objects down.

Accordingly, any number of objects may be compressed and transferred using the apparatuses and methods according to the present invention. For example, FIG. 1 illustrates the invention compressing 12 objects; FIGS. 4 and 5 illustrate the compression of two groups of 12 objects; FIG. 6 illustrates the compression of two groups of 4 objects; and finally, FIG. 7 illustrates the compression of one group of 24 items, and FIG. 8 illustrates the compression of a four-piece flat pack without the use of compression bars.

Thus, the present invention can be designed not only to accommodate any size grouping, but also to accomodate a plurality of groupings to meet most any requirement. In either case, a single rotor-ring cylinder may be used, of any length, with at least one compression member to accomplish the particular requirements, or a plurality of rotor-ring cylinders may be used in a single assembly.

It is noted that one skilled in the art will appreciate that the teachings of the present invention may also be used in mixing and compressing objects having different sizes and shapes.

While the present invention for intermittent and mixing apparatus, and variations thereof, are described in detail herein, it should be apparent that the disclosure and teachings of the present invention will suggest many other alternative designs to those skilled in the art. Accordingly, the present invention is not limited to the foregoing description.

What is claimed is:

1. A method for compressing a plurality of objects into a compressed grouping and transferring said compressed grouping with an apparatus comprising a rotatable body including a receiving area positioned on a peripheral surface of said body and extending lengthwise along said body for receiving a plurality of objects from an infeed conveyor at a receiving position, and compression members adjacent said rotatable body for forming a compressed grouping at a transfer position, and a transfer conveyor for transporting said compressed grouping away from said transfer position, said method comprising the steps of:

a. receiving a plurality of objects from said infeed conveyor into said receiving area at said receiving position;

b. rotating said rotatable body to said transfer position;

c. compressing said objects together from opposite sides of the rotatable body between said compression members to form a compressed grouping;

d. pausing said rotation of said rotatable body when said receiving area having said plurality of objects reaches said transfer position;

e. positioning a capturing element of said transfer conveyor immediately behind an end object from said receiving area when said objects arrive at said transfer position; and f. transporting said compressed grouping away from said transfer position during said pausing of the rotation of said rotatable body.

2. The method according to claim 1, wherein said rotatable body comprises a cylinder.

3. The method according to claim 1, wherein said rotatable body includes a plurality of receiving areas.

4.. The method according to claim 1, wherein said apparatus includes a plurality of rotatable bodies.

5. The method according to claim 4, wherein each of said rotatable bodies includes a plurality of receiving areas.

6. A method for compressing a plurality of objects into a compressed grouping with a compression apparatus comprising a rotatable body having two ends and a center between the two ends including a receiving area positioned on a peripheral surface of said rotatable body and extending lengthwise along said body for receiving a plurality of objects from an infeed conveyor at a receiving position, and compression members positioned on the ends of said rotatable body and surrounding a portion of the ends of said rotatable body, said compression member having an inclining portion commencing from a start position located on a side of said compression member facing the center of said rotatable body and inclining toward the center of said rotatable body to a transfer position, said start position aligned adjacent said receiving position, said method comprising the steps of:

a. receiving a plurality of objects from said infeed conveyor into said receiving area at said receiving position;

b. compressing said plurality of objects by rotating said rotatable body and said compression member relative to one another so that the object received from said infeed conveyor and positioned adjacent said start position is forced toward the longitudinal center of said rotatable body by riding along said inclined portion.

7. The method according to claim 6, wherein said start position comprises a notch.

8. The method according to claim 6, wherein said rotatable body of said compression apparatus comprises a cylinder.

9. The method according to claim 6, wherein said rotatable body includes a plurality of receiving areas.

10. The method according to claim 6, wherein said compression apparatus further comprises a plurality of rotatable bodies each having a receiving area and a compression member.

11. The method according to claim 10, wherein each said rotatable body includes a plurality of receiving areas.

12. A method for compressing a plurality of objects into a compressed grouping and transferring said compressed grouping with an apparatus comprising a rotatable body having a peripheral surface, two ends and a center between the two ends including a receiving area positioned on the peripheral surface of said rotatable body for receiving a plurality of objects in expanded arrangement from an infeed conveyor at a receiving position, a compression member positioned on an end of said rotatable body and surrounding a portion of a side of said rotatable body, said compression member having an inclining portion commencing from a start position located on the side of said compression member facing the center of said rotatable body and inclining toward the center of said rotatable body to a transfer position, said start position located adjacent said receiving position, and a transfer conveyor located adjacent said rotatable body and including a capturing member for capturing said compressed grouping at said transfer position, said method comprising the steps of:

a. receiving a plurality of objects from said infeed conveyor into one of said receiving areas at said receiving position;

b. compressing said plurality of objects by rotating said rotatable body and said compression member relative to one another so that the object received from said infeed conveyor and positioned adjacent said start position of said compression member is forced toward the center of said rotatable body by riding along said inclined portion;

c. pausing said rotation of said rotatable body when said receiving area having said compressed grouping reaches said transfer position;

d. positioning said capturing member around said compressed grouping when said compressed grouping arrives at said transfer position;

e. conveying said compressed grouping out of said receiving area at said transfer position and along said transfer conveyor.

13. The method according to claim 12, wherein said start position comprises a notch in the side of said compression member.

14. The method according to claim 12, wherein said capture member comprises a first capture element for positioning on one end of a compressed grouping and a second capture element for positioning at the other end of the compressed grouping when the compressed grouping arrives at said transfer position.

15. The method according to claim 12, wherein said apparatus further comprises a second compression member identically positioned on the end of said rotatable body opposite the end having said compression member.

16. The method according to claim 12, wherein said rotatable body includes a plurality of receiving areas.

17. The method according to claim 12, wherein said apparatus further comprises a plurality of rotatable bodies each having a receiving area and a compression member.

18. The method according to claim 17, wherein each said rotatable body includes a first compression member positioned on one end of said rotatable body, and a second compression member positioned on the other end of said rotatable body.

19. The method according to claim 12, wherein said transfer conveyor operates at a constant velocity.

20. The method according to claim 12, wherein each said rotatable body includes a plurality of receiving areas.

* * * * *